US012584432B2

(12) United States Patent
Okubo

(10) Patent No.: US 12,584,432 B2
(45) Date of Patent: Mar. 24, 2026

(54) PURIFICATION SYSTEM

(71) Applicant: ISUZU MOTORS LIMITED, Yokohama (JP)

(72) Inventor: Yasuhiro Okubo, Fujisawa (JP)

(73) Assignee: ISUZU MOTORS LIMITED, Yokohama (JP)

( * ) Notice: Subject to any disclaimer, the term of this patent is extended or adjusted under 35 U.S.C. 154(b) by 0 days.

(21) Appl. No.: 19/039,388

(22) Filed: Jan. 28, 2025

(65) Prior Publication Data

US 2025/0264046 A1 Aug. 21, 2025

(30) Foreign Application Priority Data

Feb. 19, 2024 (JP) ..... 2024-022977

(51) Int. Cl.
*F01N 3/20* (2006.01)
*F01N 3/08* (2006.01)

(52) U.S. Cl.
CPC ..... *F01N 3/206* (2013.01); *F01N 3/0814* (2013.01); *F01N 2610/02* (2013.01); *F01N 2900/104* (2013.01); *F01N 2900/1616* (2013.01)

(58) Field of Classification Search
CPC . F01N 2900/104; F01N 2610/02; F01N 3/206
See application file for complete search history.

(56) References Cited

FOREIGN PATENT DOCUMENTS

| | | | | |
|---|---|---|---|---|
| EP | 2210788 A1 * | 7/2010 | ..... | B01D 53/9495 |
| JP | 2009-113580 A | 5/2009 | | |
| JP | 2009113581 A * | 5/2009 | | |

* cited by examiner

*Primary Examiner* — Ngoc T Nguyen
(74) *Attorney, Agent, or Firm* — PROCOPIO, CORY, HARGREAVES & SAVITCH LLP

(57) ABSTRACT

[Solution] A purification system includes an engine, a catalyst that causes adsorbed ammonia to react with nitrogen oxide contained in exhaust gas of the engine to purify the exhaust gas, a motor that is driven to compensate for the difference between a) an engine load of the engine and b) a driving load, when the driving load of a driven device driven by the engine changes, a battery that supplies electricity to the motor, and a setting part that sets a target value so that the target value of the adsorption amount of the catalyst increases as the remaining capacity of the battery increases.

8 Claims, 5 Drawing Sheets

PURIFICATION SYSTEM

CROSS-REFERENCE TO RELATED APPLICATIONS

The present application claims priority to Japanese Patent Applications No. 2024-22977, filed on Feb. 19, 2024, contents of which are incorporated herein by reference in their entirety.

BACKGROUND OF THE INVENTION

The present disclosure relates to a purification system for purifying exhaust gas of an engine. A technique for purifying exhaust gas of an engine is known. Japanese Unexamined Patent Application Publication No. 2009-113580 discloses a technique for purifying exhaust gas by providing, in an exhaust passage of an engine, a catalyst that adsorbs ammonia and facilitates a reaction between the adsorbed ammonia and nitrogen oxides in the exhaust gas.

When a large amount of ammonia is adsorbed to a catalyst, the reaction between nitrogen oxides in exhaust gas and the ammonia is facilitated, thereby improving an exhaust gas purification rate. However, if exhaust gas temperature increases while a large amount of ammonia is adsorbed to a catalyst, there is a risk that the ammonia may desorb from the catalyst and be released into the atmosphere without reacting with nitrogen oxides.

BRIEF SUMMARY OF THE INVENTION

The present disclosure focuses on this point, and an object thereof is to achieve both improvement of an exhaust gas purification rate and suppression of release of ammonia to the atmosphere.

An aspect of the present disclosure provides a purification system including an engine, a catalyst that causes adsorbed ammonia to react with nitrogen oxide contained in exhaust gas of the engine to purify the exhaust gas, a motor that assists the engine, a battery that supplies electricity to the motor, and an injection controller that controls an amount of urea to be injected so that an adsorption amount of the ammonia adsorbed to the catalyst increases as remaining capacity of the battery increases.

DETAILED DESCRIPTION OF THE INVENTION

Hereinafter, the present disclosure will be described through exemplary embodiments of the present disclosure, but the following exemplary embodiments do not limit the disclosure according to the claims, and not all of the combinations of features described in the exemplary embodiments are necessarily essential to the solution means of the disclosure.

[Configuration of Purification System S]

Figure 1:
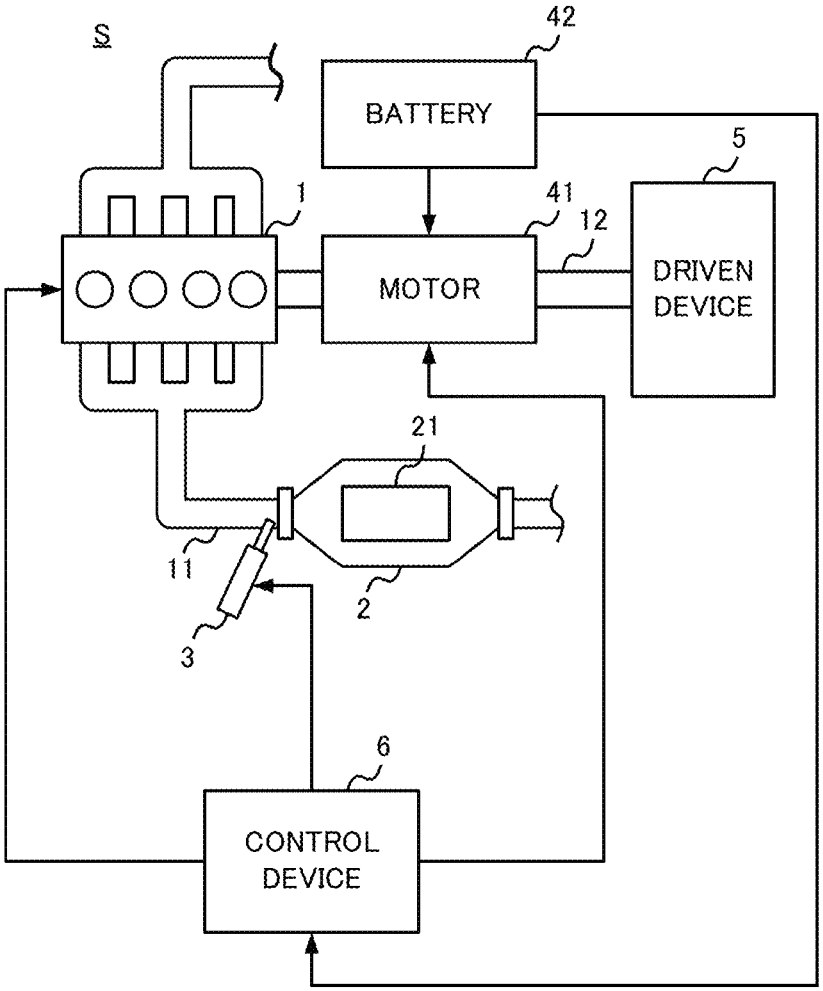
FIG. 1 illustrates a configuration of a purification system according to the present embodiment.

FIG. 1 illustrates a configuration of a purification system S according to the present embodiment. The purification system S shown in FIG. 1 is a system for purifying exhaust gas of an engine 1. The purification system S is provided in a vehicle, a ship, and the like, for example. In the following description, the purification system S is assumed to be mounted on a vehicle. The purification system S includes the engine 1, a purification device 2, a urea injection part 3, a driven device 5, a control device 6, a motor 41, and a battery 42.

The engine 1 is an internal combustion engine that generates power by combusting and expanding a mixture of fuel and intake air. The engine 1 is a diesel engine, for example, but may be a gasoline engine. The driven device 5 is coupled to an output shaft 12 of the engine 1. The engine 1 drives the driven device 5.

The driven device 5 is a transmission, a drive shaft, and a tire-wheel assembly, for example, but is not limited thereto. In the following description, a load required to drive the driven device 5 may be referred to as a driving load.

The motor 41 is provided between the engine 1 and the driven device 5 on the output shaft 12. The motor 41 assists the engine 1 and drives the driven device 5. The motor 41 is operated by electricity supplied from the battery 42. Further, the motor 41 also functions as a generator. The motor 41 generates electricity by being driven by the power of the engine 1.

The purification device 2 is provided in an exhaust pipe 11 that discharges exhaust gas of the engine 1 to the outside. The purification device 2 purifies the exhaust gas discharged from the engine 1. A catalyst 21 is provided inside the purification device 2. The catalyst 21 is a selective reduction catalyst that purifies the exhaust gas by causing nitrogen oxides contained in the exhaust gas to react with ammonia. Specifically, the catalyst 21 facilitates the reaction between nitrogen oxides and ammonia at or above its activation temperature, thereby converting the nitrogen oxides into water and nitrogen. The activation temperature is 200 degrees Celsius, for example, but is not limited thereto.

The urea injection part 3 is provided between the engine 1 and the catalyst 21 in the exhaust pipe 11. The urea injection part 3 injects urea, which is a precursor of ammonia, into the exhaust pipe 11. Specifically, the urea injection part 3 injects urea water containing urea into the exhaust pipe 11. Urea in the urea water injected into the exhaust pipe 11 is hydrolyzed to ammonia by heat of the exhaust gas. The ammonia is adsorbed to the catalyst 21. The catalyst 21 facilitates the reaction between the adsorbed ammonia and the nitrogen oxides contained in the exhaust gas to purify the exhaust gas.

When a large amount of ammonia is adsorbed to the catalyst 21, the reaction between the nitrogen oxides in the exhaust gas and the ammonia is facilitated, thereby improving an exhaust gas purification rate. However, an adsorption capacity limit indicating the maximum amount of ammonia that can be adsorbed to the catalyst 21 is determined on the basis of the temperature of the catalyst 21. Specifically, the adsorption capacity limit decreases as the temperature of the catalyst 21 increases. Therefore, when the temperature of the catalyst 21 increases due to an increase in exhaust gas temperature, the adsorption capacity limit decreases, and ammonia adsorbed to the catalyst 21 desorbs. It should be noted that the temperature of the catalyst 21 is linked to the exhaust gas temperature, therefore, in the following description, the temperature of the catalyst 21 is assumed to be equal to the exhaust gas temperature.

Figure 2:
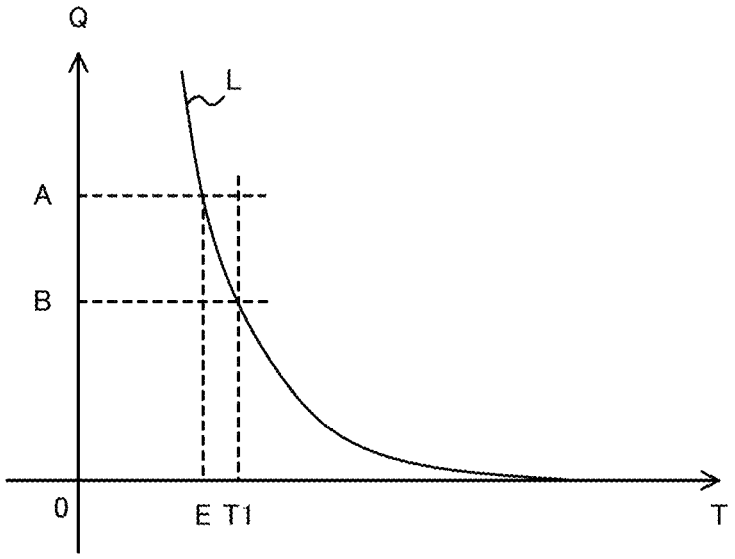
FIG. 2 illustrates a relationship between exhaust gas temperature and an adsorption capacity limit.

FIG. 2 illustrates a relationship between the exhaust gas temperature and the adsorption capacity limit. In FIG. 2, the horizontal axis represents exhaust gas temperature T, and the vertical axis represents an adsorption amount of ammonia Q on the catalyst 21. An adsorption capacity limit L is a graph showing an adsorption capacity limit according to the exhaust gas temperature T. The adsorption capacity limit L decreases as the exhaust gas temperature T increases. An activation temperature E is a temperature at which the catalyst 21 is activated. As described above, since the temperature of the catalyst 21 is linked to the exhaust gas temperature T, when the exhaust gas temperature T becomes equal to or higher than the activation temperature E, the catalyst 21 temperature also becomes equal to or higher than the activation temperature E. Hereinafter, desorption of ammonia adsorbed to the catalyst 21 due to an increase in the exhaust gas temperature T will be described.

For example, when the exhaust gas temperature Tis at the activation temperature E and the adsorption amount of ammonia Q is at a first adsorption amount A, the exhaust gas temperature T increases to temperature T1. In this case, the adsorption capacity limit L of ammonia decreases from the first adsorption amount A to a second adsorption amount B. That is, ammonia can only be adsorbed to the catalyst 21 up to the second adsorption amount B. Therefore, an amount of ammonia corresponding to a difference between the first adsorption amount A and the second adsorption amount B desorbs from the catalyst 21 and is released into the atmosphere. Conversely, even when a large amount of ammonia is adsorbed to the catalyst 21, if the exhaust gas temperature T does not increase, the ammonia adsorbed to the catalyst 21 does not desorb and therefore is not released into the atmosphere.

Therefore, the control device 6 suppresses the increase in the exhaust gas temperature by operating the engine 1 in a steady state so that an engine load of the engine 1 is constant, thereby suppressing the release of ammonia into the atmosphere. During the steady-state operation of the engine 1, the control device 6 causes the motor 41 to output for compensating a difference between a) the driving load of the driven device 5 and b) the engine load of the engine 1 during the steady-state operation. The amount of load by which the motor 41 can compensate for the difference is determined by the remaining capacity of the battery 42, and is greater as the remaining capacity of the battery 42 is larger. For example, when the remaining capacity of the battery 42 is large, the motor 41 can compensate for the difference in load over a longer period. This allows the engine 1 to continue its steady-state operation even if the driving load remains greater than the engine load of the engine 1 during steady-state operation.

When the engine 1 is in the steady-state operation, the increase in the exhaust gas temperature is suppressed, thereby reducing the risk of ammonia desorbing from the catalyst 21 due to the increase in the exhaust gas temperature, even when a large amount of ammonia is adsorbed to the catalyst 21. If the risk of desorption of ammonia is small, the control device 6 increases the adsorption amount of ammonia on the catalyst 21. The increase in the adsorption amount of ammonia on the catalyst 21 facilitates purification of the exhaust gas by the catalyst 21, thereby improving the exhaust gas purification rate. In this way, the control device 6 can achieve both suppression of the release of ammonia to the atmosphere and the improvement of the exhaust gas purification rate. Hereinafter, the configuration of the control device 6 will be specifically described.

[Configuration of Control Device 6]

Figure 3:
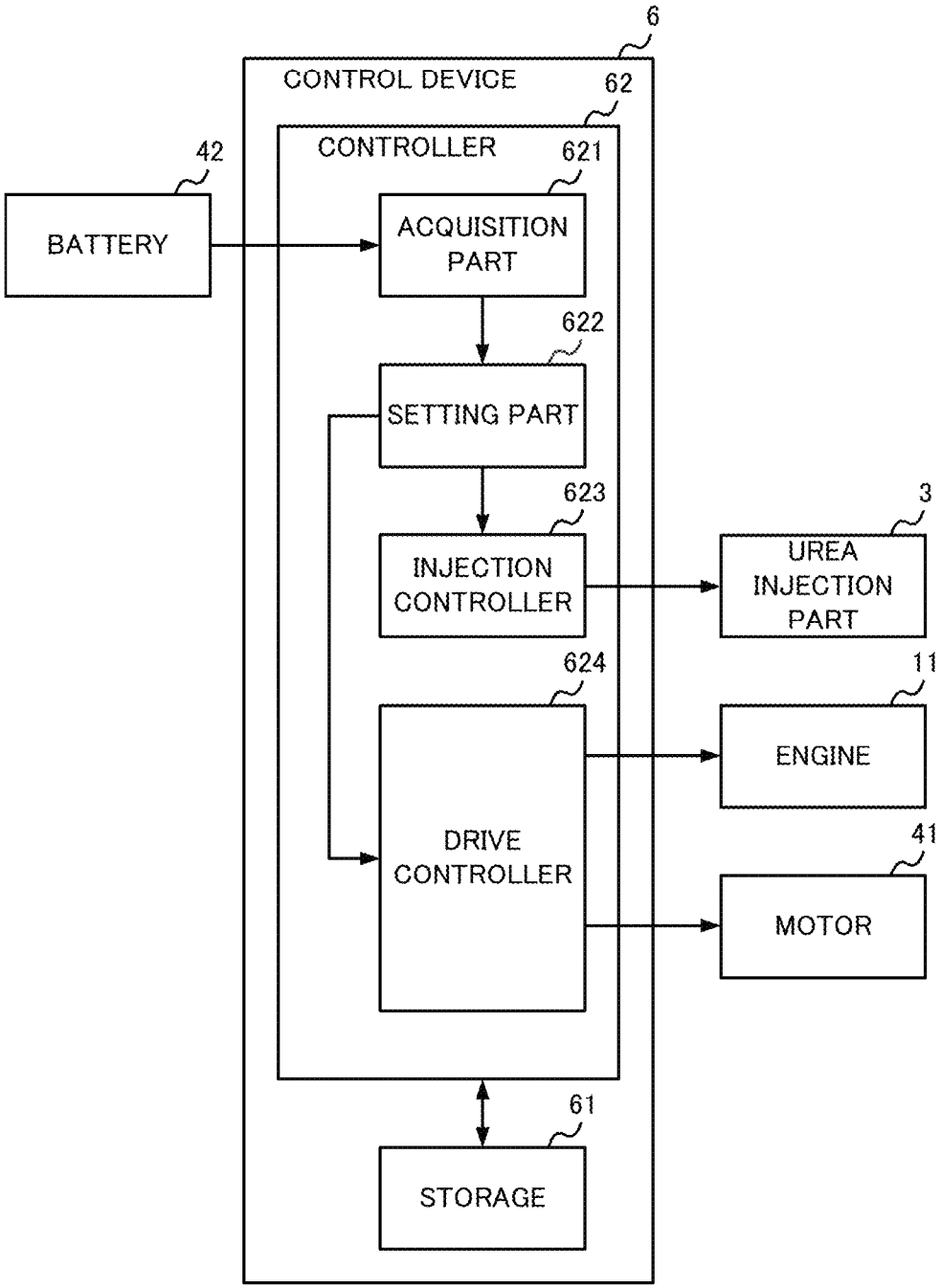
FIG. 3 illustrates a configuration of a control device.

FIG. 3 illustrates a configuration of a control device 6. The control device 6 includes a storage 61 and a controller 62. The storage 61 is a storage medium including a Read Only Memory (ROM), a Random Access Memory (RAM), a hard disk, and the like. The storage 61 stores a program executed by the controller 62.

The controller 62 is a calculation resource including a processor such as a Central Processing Unit (CPU). The controller 62 achieves functions of an acquisition part 621, a setting part 622, an injection controller 623, and a drive controller 624 by executing the program stored in the storage 61.

The acquisition part 621 acquires information related to the purification system S. The acquisition part 621 acquires the remaining capacity of the battery 42, for example. The acquisition part 621 acquires capacity information indicating the remaining capacity from a battery monitoring system that monitors the remaining capacity of the battery 42. The acquisition part 621 may i) calculate power consumption of the motor 41 from an output of the motor 41, and ii) acquire a value obtained by subtracting the power consumption of the motor 41 from the maximum capacity of the battery 42 for a period from when the battery 42 reaches the maximum capacity to the present time, as the remaining capacity of the battery 42.

The acquisition part 621 acquires load information indicating the driving load of the driven device 5. For example, the acquisition part 621 acquires the load information indicating the driving load of the driven device 5 from a sensor provided in the driven device 5. The sensor is a torque sensor that detects torque as the driving load, for example, but is not limited thereto.

Figure 4:
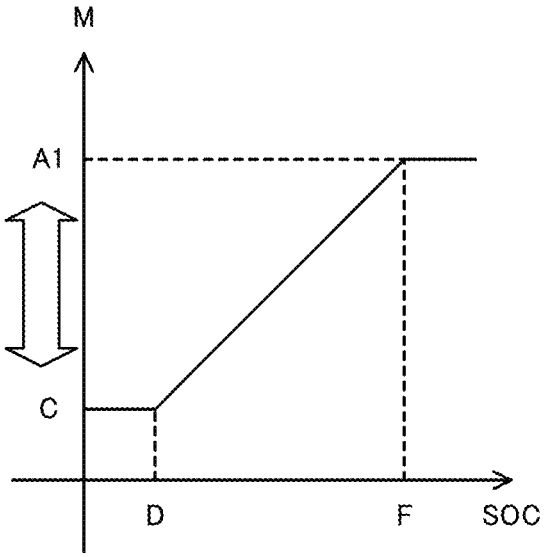
FIG. 4 illustrates a relationship between remaining capacity and a target value.

The setting part 622 sets a target value of the adsorption amount of ammonia on the catalyst 21. For example, the setting part 622 sets a target value M according to remaining capacity SOC. FIG. 4 illustrates a relationship between the remaining capacity SOC and the target value M. In FIG. 4, the horizontal axis represents the remaining capacity SOC, and the vertical axis represents the target value M of the adsorption amount.

A lower limit target value C is defined as a value at which the ammonia is not insufficient relative to the nitrogen oxides contained in the exhaust gas. In other words, the lower limit target value C is defined as an adsorption amount at which the exhaust gas purification rate of the catalyst 21 is maintained at or above a predetermined purification rate lower limit value. The purification rate lower limit value corresponds to a value at which an amount of nitrogen oxides emitted to the atmosphere remains below an emission reference value, for example. It should be noted that, if the adsorption amount falls below the lower limit target value C, the ammonia becomes insufficient relative to the nitrogen oxides, making it impossible to adequately purify the exhaust gas.

The setting part 622 sets the target value M for the adsorption amount at which the catalyst 21 can purify the exhaust gas even if the remaining capacity SOC is small. Specifically, the setting part 622 sets the target value M to the lower limit target value C if the remaining capacity SOC is less than first capacity D. This ensures that the setting part 622 can maintain the exhaust gas purification rate at or above the purification rate lower limit value even if the remaining capacity SOC is small.

An upper limit target value A1 is a limit value of an amount of ammonia that the catalyst 21 can adsorb when the exhaust gas temperature is the activation temperature E, and is equal to the first adsorption amount A (see FIG. 2). If a larger amount of ammonia than the upper limit target value A1 is supplied to the catalyst 21 at the activation temperature E, some of the supplied ammonia cannot be adsorbed to the catalyst 21 and is released to the atmosphere. If the exhaust gas temperature is lower than the activation temperature E, the catalyst 21 can adsorb the larger amount of ammonia than the upper limit target value A1, but cannot facilitate the reaction between the adsorbed ammonia and the nitrogen oxide. Therefore, it is unnecessary to supply ammonia to the catalyst 21 in an amount equal to or higher than the upper limit target value A1.

The setting part 622 sets the target value M to be equal to or less than the upper limit target value A1 in order to suppress unnecessary ammonia supply. Specifically, the setting part 622 sets the target value M to the upper limit target value A1 if the remaining capacity SOC is equal to or greater than second capacity F which is larger than the first capacity D. More specifically, the setting part 622 sets the upper limit target value A1 to the target value M if the exhaust gas temperature is the activation temperature E and the remaining capacity SOC is equal to or greater than the second capacity F. The second capacity F is 80% of the maximum capacity of the battery 42, but is not limited thereto and may be the maximum capacity. This allows the setting part 622 to prevent an unnecessarily large amount of ammonia from being supplied to the catalyst 21.

If the remaining capacity SOC is equal to or more than the first capacity D and less than the second capacity F, the setting part 622 sets the target value M greater than the lower limit target value C as the remaining capacity SOC increases. The setting part 622 sets the target value M corresponding to the remaining capacity SOC acquired by the acquisition part 621 with reference to relationship information indicating the relationship between the remaining capacity SOC and the target value M. The relationship information is a data table in which the target value M is associated with each of the plurality of remaining capacities SOC. The data table is stored in the storage 61, for example. The relationship information may be a function that outputs the target value M when the remaining capacity SOC is inputted. The function is a function that outputs the target value M by multiplying the remaining capacity SOC by a positive coefficient, for example. As described above, the setting part 622 can increase the target value M for the adsorption amount as the amount of load by which the motor 41 can compensate for the difference between the engine load of the engine 1 during the steady-state operation and the driving load becomes larger, thereby improving the exhaust gas purification rate.

The injection controller 623 causes the urea injection part 3 to inject urea water containing urea into the exhaust pipe 11. The injection controller 623 causes the urea injection part 3 to inject urea water into the exhaust pipe 11 so that the adsorption amount of ammonia on the catalyst 21 becomes the target value M set by the setting part 622. Specifically, the injection controller 623 first estimates an estimated adsorption amount of ammonia adsorbed to the catalyst 21 at the present time on the basis of the amount of exhaust gas emitted from the exhaust pipe 11 and the amount of urea water injected up to the present time. Next, the injection controller 623 determines whether or not the estimated adsorption amount is less than the target value M. If the estimated adsorption amount is less than the target value M, the injection controller 623 specifies the difference between the estimated adsorption amount and the target value M.

The injection controller 623 then causes the urea injection part 3 to inject urea water into the exhaust pipe 11 in an amount corresponding to the difference between the estimated adsorption amount and the target value M. Specifically, the injection controller 623 increases the amount of urea water to be injected by the urea injection part 3 as the difference between the estimated adsorption amount and the target value M becomes larger, if the estimated adsorption amount is below the target value M. In this way, the injection controller 623 can increase the adsorption amount of ammonia on the catalyst 21.

If the estimated adsorption amount is equal to or greater than the target value M, the injection controller 623 does not specify the difference between the estimated adsorption amount and the target value M, and does not cause the urea injection part 3 to inject the urea water into the exhaust pipe 11. This allows the injection controller 623 to suppress unnecessary ammonia supply to the catalyst 21.

As described in FIG. 2, supplying ammonia to the catalyst 21 in an amount exceeding the adsorption capacity limit L causes some of the supplied ammonia to be released without being adsorbed by the catalyst 21. Therefore, the setting part 622 sets the target value M so that the adsorption amount of ammonia Q does not exceed the adsorption capacity limit L. The setting part 622 sets the adsorption capacity limit L to the target value M if the target value M determined according to the remaining capacity SOC is greater than the adsorption capacity limit L determined according to the exhaust gas temperature. This allows the setting part 622 to prevent an unnecessarily large amount of ammonia from being supplied.

The drive controller 624 controls the engine 1. When the setting part 622 sets the target value M greater than the lower limit target value C, the drive controller 624 causes the engine 1 to operate in the steady state so that the engine load of the engine 1 is constant. Specifically, the drive controller 624 causes the engine 1 to operate in the steady state so that the engine load of the engine 1 is constant and the exhaust gas temperature becomes equal to or higher than the activation temperature E of the catalyst 21. More specifically, the drive controller 624 causes the engine 1 to operate in the steady state so that the exhaust gas temperature becomes equal to or higher than the activation temperature E and equal to or lower than upper limit temperature F.

The magnitude relationship between the engine load of the engine 1 during steady-state operation and the driving load of the driven device 5 varies. For example, when the vehicle is traveling uphill or accelerating, the driving load of the driven device 5 becomes greater than the engine load of the engine 1 during steady-state operation. Conversely, when the vehicle is traveling downhill or coasting, the driving load of the driven device 5 becomes smaller than the engine load of the engine 1 during steady-state operation.

Therefore, the drive controller 624 switches the operation of the motor 41 according to the magnitude relationship between the engine load of the engine 1 during steady-state operation and the driving load of the driven device 5. That is, the drive controller 624 switches between causing the motor 41 to a) output power and b) generate electricity, on the basis of the magnitude relationship between the engine load of the engine 1 and the driving load.

If the driving load is greater than the engine load of the engine 1 during steady-state operation, the drive controller 624 causes the motor 41 to output power corresponding to a difference between the engine load of the engine 1 during steady-state operation and the driving load. Specifically, the drive controller 624 controls the output current of the battery 42 to supply electricity from the battery 42 to the motor 41, so that the output of the motor 41 becomes equal to the difference. In this way, the drive controller 624 can operate the engine 1 in the steady state even when the vehicle is traveling uphill or accelerating, and can keep the exhaust gas temperature constant. If the driving load is smaller than the engine load of the engine 1 during steady-state operation, the drive controller 624 causes the motor 41 to generate electricity using the difference between the engine load of the engine 1 during steady-state operation and the driving load, by causing the motor 41 to function as a generator. Specifically, the drive controller 624 causes the motor 41 to generate electricity corresponding to the difference between the engine load of the engine 1 during steady-state operation and the driving load. As described above, the drive controller 624 causes the motor 41 to function as a generator, thereby operating the engine 1 in the steady state so that the engine load of the engine 1 does not decrease.

[Process for Setting Target Value M]

Figure 5:
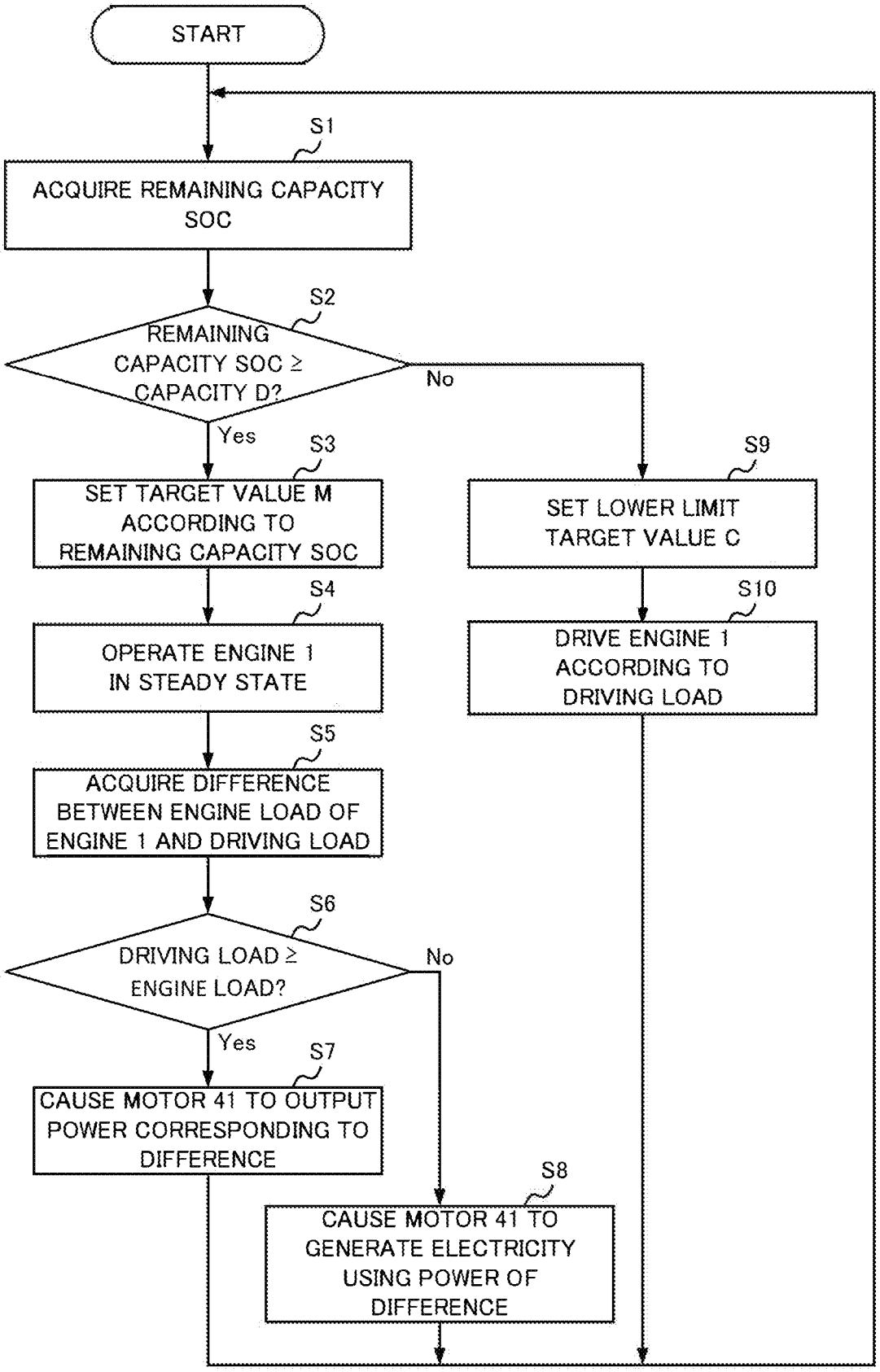
FIG. 5 is a flowchart showing an example of a process for setting the target value.

FIG. 5 is a flowchart showing an example of a process for setting the target value M. The process for setting the target value M is executed at predetermined intervals during the operation of the engine 1. The predetermined interval is 100 milliseconds, for example, but is not limited thereto.

The acquisition part 621 acquires the remaining capacity SOC of the battery 42 (step S1). Specifically, the acquisition part 621 acquires capacity information indicating remaining capacity from the battery monitoring system that monitors the remaining capacity of the battery 42.

The setting part 622 determines whether or not the remaining capacity SOC is equal to or greater than the first capacity D (step S2). If the remaining capacity SOC is equal to or greater than the first capacity D (Yes in step S2), the setting part 622 sets the target value M according to the remaining capacity SOC (step S3).

The drive controller 624 causes the engine 1 to operate in the steady state so that the engine load of the engine 1 is constant (step S4). Specifically, the drive controller 624 causes the engine 1 to operate in the steady state so that i) the exhaust gas temperature becomes equal to or higher than the activation temperature E and equal to or lower than the upper limit temperature and ii) the engine load of the engine 1 is constant.

The acquisition part 621 acquires the difference between the engine load of the engine 1 during steady-state operation and the driving load (step S5). The drive controller 624 determines whether or not the driving load is equal to or greater than the engine load (step S6). If the driving load is equal to or greater than the engine load (Yes in step S6), the drive controller 624 causes the motor 41 to output power corresponding to the difference (step S7). Specifically, the drive controller 624 controls the current to be applied to the motor 41 so that the output of the motor 41 becomes equal to the difference.

If the driving load is less than the engine load (No in step S6), the drive controller 624 causes the motor 41 to generate electricity using power corresponding to the difference (step S8). Specifically, the drive controller 624 causes the motor 41 to generate electricity corresponding to the difference between the engine load of the engine 1 during steady-state operation and the driving load.

If the remaining capacity SOC is less than the first capacity D (No in step S2), the setting part 622 sets the lower limit target value C to the target value M (step S9). The drive controller 624 drives the engine 1 according to the driving load (step S10).

[Effects of Purification System S]

As described above, the purification system S according to the embodiment includes the engine 1, the catalyst 21, the motor 41, and the battery 42 that supplies electricity to the motor 41. The catalyst 21 purifies the exhaust gas by causing the adsorbed ammonia react with the nitrogen oxides contained in the exhaust gas of the engine 1. The motor 41 is driven to compensate for the difference between a) the driving load of the driven device 5 driven by the engine 1 and b) the engine load of the engine 1. The purification system S then increases the target value M of the adsorption amount of ammonia on the catalyst 21 as the remaining capacity of the battery 42 increases.

According to the above configuration, the purification system S of the present disclosure can increase the adsorption amount of ammonia on the catalyst 21 as the remaining capacity of the battery 42 increases. Further, in the purification system S, the difference between the driving load and the engine load of the engine 1 is compensated by the motor 41 driven by the battery 42, thereby suppressing fluctuation in the engine load of the engine 1. As a result, the purification system S can operate the engine 1 in the steady state, which suppresses the increase in the exhaust gas temperature of the engine 1. Thus, the purification system S can suppress the release of ammonia to the outside even if the adsorption amount of ammonia on the catalyst 21 is increased. Furthermore, the adsorption amount of ammonia on the catalyst 21 can be increased, which facilitates the reaction between nitrogen oxides and ammonia on the catalyst 21. As a result, the exhaust gas purification rate is improved. In this manner, the purification system S can achieve both the improvement of the purification rate and the suppression of release of ammonia to the atmosphere.

The present disclosure is explained on the basis of the exemplary embodiments. The technical scope of the present disclosure is not limited to the scope explained in the above embodiments and it is possible to make various changes and modifications within the scope of the disclosure. For example, all or part of the apparatus can be configured with any unit which is functionally or physically dispersed or integrated. Further, new exemplary embodiments generated by arbitrary combinations of them are included in the exemplary embodiments of the present disclosure. Further, effects of the new exemplary embodiments brought by the combinations also have the effects of the original exemplary embodiments.

The invention claimed is:

1. A purification system comprising:

an engine;

a catalyst that causes adsorbed ammonia to react with nitrogen oxide contained in exhaust gas of the engine to purify the exhaust gas;

a motor that assists the engine;

a battery that supplies electricity to the motor;

an injection controller that controls an amount of urea to be injected so that an adsorption amount of the ammonia adsorbed to the catalyst increases as remaining capacity of the battery increases; and a setting part that sets a target value so that the target value of the adsorption amount of the catalyst increases as the remaining capacity increases, wherein the injection controller injects the urea so that the adsorption amount becomes the target value.

2. The purification system according to claim 1, wherein if the remaining capacity is less than a first capacity, the setting part sets, as the target value of the adsorption amount, an adsorption amount at which a purification rate of the exhaust gas by the catalyst is equal to or greater than a value at which an amount of the nitrogen oxides emitted to atmosphere is less than an emission reference value.

3. The purification system according to claim 1, wherein if the remaining capacity is equal to or greater than second capacity and exhaust gas temperature of the engine is an activation temperature of the catalyst, the setting part sets the target value to an upper limit target value of an amount of the ammonia that the catalyst is configured to be adsorbed.

4. The purification system according to claim 3, wherein if a target value determined according to the remaining capacity is greater than an adsorption capacity limit indicating a maximum amount of the ammonia that the catalyst is configured to be adsorbed, which is determined according to the exhaust gas temperature, the setting part sets the upper limit target value to the target value.

5. The purification system according to claim 1, comprising:

a urea injection part that is provided in an exhaust pipe for discharging the exhaust gas to an outside and injects the urea into the exhaust pipe, wherein the catalyst is provided downstream of the urea injection part in the exhaust pipe, and the injection controller causes the urea injection part to inject the urea into the exhaust pipe in an amount corresponding to a difference between:

a) an estimated amount of the adsorption amount of the ammonia adsorbed to the catalyst at a present time; and b) the target value set by the setting part.

6. The purification system according to claim 5, wherein the injection controller causes;

an injection amount of the urea to be injected into the urea injection part to be increased as the difference between the estimated amount and the target value increases, if the estimated amount is less than the target value; and the urea injection part not to inject the urea into the exhaust pipe if the estimated amount is equal to or greater than the target value.

7. A purification system, comprising:

an engine;

a catalyst that causes adsorbed ammonia to react with nitrogen oxide contained in exhaust gas of the engine to purify the exhaust gas;

a motor that assists the engine;

a battery that supplies electricity to the motor;

an injection controller that controls an amount of urea to be injected so that an adsorption amount of the ammonia adsorbed to the catalyst increases as remaining capacity of the battery increases; and a drive controller that causes the engine to operate in a steady state so that i) an exhaust gas temperature of the engine becomes equal to or higher than an activation temperature of the catalyst and ii) an engine load of the engine is constant.

8. The purification system according to claim 7, wherein the drive controller causes:

the motor to output, if a driving load of a driven device driven by the engine is greater than the engine load of the engine during steady-state operation, power corresponding to a difference between the engine load of the engine during steady-state operation and the driving load; and the motor to generate, if the driving load is smaller than the engine load of the engine during steady-state operation, electricity corresponding to the difference by causing the motor to function as a generator.

* * * * *